US005399031A

United States Patent [19]

Whritenor

[11] Patent Number: 5,399,031

[45] Date of Patent: Mar. 21, 1995

[54] ASSISTING MOVEMENT OF DYE RECEIVER PAST THERMAL PRINT HEAD

[75] Inventor: James A. Whritenor, Mendon, N.Y.

[73] Assignee: Eastman Kodak Company, Rochester, N.Y.

[21] Appl. No.: 22,202

[22] Filed: Feb. 25, 1993

[51] Int. Cl.[6] ..... B41J 2/325

[52] U.S. Cl. ..... 400/120.04; 400/120.16; 400/225; 346/136

[58] Field of Search ..... 400/120.04, 120.16, 400/225, 230, 240.3, 120 MP; 346/76 PH, 134, 136

[56] References Cited

U.S. PATENT DOCUMENTS

| | | | |
|---|---|---|---|
| 4,388,628 | 6/1983 | Moriguchi et al. | 346/76 PH |
| 4,399,749 | 8/1983 | Arai | 101/211 |
| 4,458,253 | 7/1984 | Goff, Jr. et al. | 346/76 PH |
| 4,502,057 | 2/1985 | Kawano et al. | 346/76 PH |
| 4,517,591 | 5/1985 | Nagashima et al. | 358/75 |
| 4,542,387 | 9/1985 | Nagashima et al. | 346/76 PH |
| 4,552,470 | 11/1985 | Yana et al. | 400/120 |
| 4,562,443 | 12/1985 | Matsuno et al. | 346/76 PH |
| 4,590,490 | 5/1986 | Takanashi et al. | 346/76 PH |
| 4,594,597 | 6/1986 | Liu et al. | 346/76 PH |
| 4,616,236 | 10/1986 | Watanabe et al. | 346/76 PH |
| 4,631,577 | 12/1986 | Yamanishi | 358/75 |
| 4,642,655 | 2/1987 | Sparer et al. | 346/76 PH |
| 4,675,698 | 6/1987 | Tsutsumi | 346/76 PH |
| 4,698,646 | 10/1987 | Satoh et al. | 346/76 PH |
| 4,707,703 | 11/1987 | Toida et al. | 346/1.1 |
| 4,710,041 | 12/1987 | Shimada et al. | 400/120 |
| 4,710,781 | 12/1987 | Stephenson | 346/76 PH |
| 4,738,555 | 4/1988 | Nagashima | 400/240 |
| 4,755,834 | 7/1988 | Kunimitsu et al. | 346/76 PH |
| 4,760,405 | 7/1988 | Nagira et al. | 346/1.1 |
| 4,774,525 | 9/1988 | Mitsushima et al. | 346/76 PH |
| 4,794,404 | 12/1988 | Shiraishi et al. | 346/76 PH |
| 4,815,872 | 3/1989 | Nagashima | 400/120 |
| 4,835,603 | 5/1989 | Kano et al. | 358/75 |
| 4,891,652 | 1/1990 | Sato et al. | 346/76 PH |
| 4,899,171 | 2/1990 | Ogura et al. | 346/76 PH |
| 4,943,812 | 7/1990 | Yokoyama et al. | 346/1.1 |
| 4,990,933 | 2/1991 | Hatakeyama et al. | 346/76 PH |
| 5,021,804 | 6/1991 | Nozawa et al. | 346/76 PH |
| 5,026,180 | 6/1991 | Tajima et al. | 400/120 |
| 5,036,338 | 7/1991 | Imai | 346/76 PH |

FOREIGN PATENT DOCUMENTS

| | | | |
|---|---|---|---|
| 000535 | 1/1990 | Japan | 400/120.04 |
| 102085 | 4/1990 | Japan | 400/120.04 |

*Primary Examiner*—David A. Wiecking
*Assistant Examiner*—Steven S. Kelley
*Attorney, Agent, or Firm*—Raymond L. Owens

[57] ABSTRACT

A color thermal printer loads a dye receiver for printing by moving the dye receiver in a first direction through a gap between a print head and a platen. A dye donor, also positioned in the gap, moves in the first direction during receiver loading. The moving dye donor engages the dye receiver, assisting the dye receiver through the gap. When the dye receiver is detected downstream of the gap, the dye receiver is positioned in a beginning receiver print position and the position of the dye donor with respect to the print head is determined. If the print head position is downstream of a beginning donor print position, the dye donor is rewound in a second direction opposite the first direction until the print head is upstream of the beginning donor print position, whereupon the dye donor is moved to the beginning donor print position. If the print head position is upstream of the beginning donor print position when the dye receiver is detected, the dye donor is moved to the beginning donor print position. A normal printing sequence occurs when both dye donor and dye receiver are in their respective beginning print positions.

6 Claims, 4 Drawing Sheets

ASSISTING MOVEMENT OF DYE RECEIVER PAST THERMAL PRINT HEAD

FIELD OF INVENTION

The present invention relates to a color thermal printing system using a dye receiver and a dye donor movable past a print head.

BACKGROUND OF THE INVENTION

Color thermal printers with a small roller platen use a dye donor and a dye receiver positioned between a print head and the platen for printing information upon the dye receiver. A printing operation typically begins with a loading sequence in which the print head and dye donor are spaced away from the roller platen, and the dye receiver is moved from a supply tray along a receiver transport path defined by a receiver transport mechanism. The receiver transport mechanism urges the dye receiver toward a gap between the print head and the roller platen. After moving through the gap, the dye receiver is positioned appropriately and a printing sequence occurs where information is printed on the dye receiver.

A problem occurs during the loading sequence as the dye receiver initially approaches the gap between the print head and the platen. The stiffness of the dye receiver can cause it to engage the dye donor upstream of the gap, instead of passing through the gap without touching the dye donor. The friction from the dye receiver engaging the dye donor requires greater drive forces to move the dye receiver through the gap than would otherwise be necessary.

One method to overcome this problem is to increase the power or complexity of the receiver transport mechanism, incurring the disadvantages of increased cost and complexity.

Another method to overcome this problem is to space the print head and dye donor a larger distance from the roller platen during the loading sequence. This has the disadvantages of increasing the printer's volume and print operation time.

Yet another method to solve this problem is provided by this invention, in which the dye donor is moved in the same direction as the dye receiver during the loading sequence to reduce friction between the dye donor and dye receiver. When the dye receiver has passed through the gap, the dye donor is moved in a reverse direction to rewind it and thus minimize unused dye donor.

SUMMARY OF THE INVENTION

An object of this invention is to reduce friction between a dye receiver and a dye donor during a loading sequence of a thermal printer's operation.

A further object of this invention is to reduce the force necessary to move a dye receiver through a gap between a print head and a platen during the thermal printer's loading sequence.

These objects are achieved by a color thermal printer which includes a dye donor with repeating groups of sequential color patches, a print head, a platen and a receiver transport path, comprising means for moving a dye receiver in a first direction along the receiver transport path to a gap between the print head and the platen; and means for moving said dye donor in said first direction while said dye receiver is moving in said first direction so that the dye donor engages said dye receiver and urges said dye receiver through said gap.

A feature of this invention is to minimize unused dye donor by detecting the dye receiver in the receiver transport path downstream of the gap and generating a receiver present signal; stopping the dye donor movement in response to the receiver present signal; positioning the dye receiver to a beginning receiver print position in response to the receiver present signal; positioning the dye donor to a beginning donor print position subsequent to stopping the dye donor movement; and printing information upon said dye receiver.

Another feature of this invention is to position the dye donor to a beginning print position by sensing which color patch is positioned in the gap and generating a color patch signal; determining the position of the print head relative to the first color patch in the next group of color patches and generating a donor drive direction signal representative of the direction the dye donor must move to position the dye donor at the beginning donor print position; and transporting the dye donor in response to the donor drive direction signal to the beginning donor print position.

Advantages

The advantages of this invention include:

1. less force is necessary to move the dye receiver through gap between print head and platen during the loading sequence;
2. the amount of dye donor used for a given print operation is minimized;
3. the smaller volume of dye donor required to provide a given number of prints permits the smallest volume allocation for dye donor within the printer, consequently permitting the smallest possible printer volume;
4. the print cycle operation is insensitive to changes in dye donor spools;
5. the print cycle operation is insensitive to print size variations which can impact the dye donor movement or rewind functions;
6. the print cycle operation is insensitive to the distance which a dye receiver must travel along a receiver transport path before reaching the proper printing position;
7. no expensive metering methods are needed to position dye donor;
8. a simpler, less complex mechanism to transport the dye receiver is possible;
9. the amount of time required to complete the print cycle is minimized; and
10. the loading sequence is less sensitive to variations in the gap between the print head and the roller platen.

DESCRIPTION OF THE PREFERRED EMBODIMENTS

In accordance with this invention, apparatus is provided for loading of a dye receiver by moving a dye donor in the same direction as the dye receiver during a loading sequence, positioning the dye donor at a beginning donor print position using a bi-directional donor drive and also positioning the dye receiver at a beginning receiver print position prior to normal printing operations.

An embodiment of the present invention will be described by referring to FIGS. 1 to 4.

Figure 1:
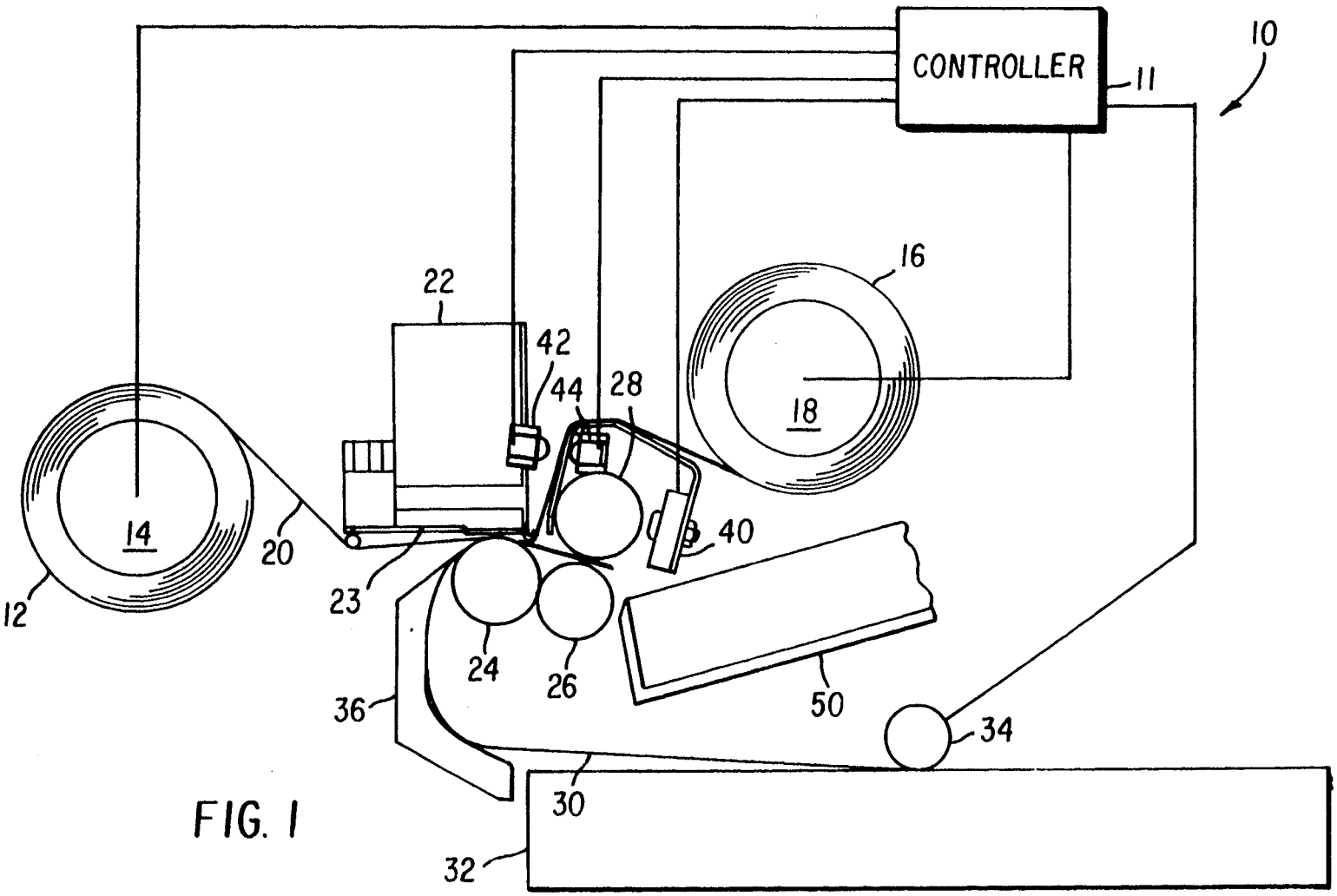
FIG. 1 is a schematic of a portion of a thermal printer.

A preferred embodiment for loading a dye receiver 30 can be understood by referring to FIG. 1. A thermal printer 10 has a receiver loading sequence which begins with a print head 23 located away from a roller platen 24, releasing a dye donor 20 from any clamping pressure and leaving a first gap between the print head 23 and the roller platen 24. The dye donor includes a repeating groups of sequential color patches.

At the beginning of a print cycle, the dye receiver 30 is moved from a supply tray 32 where enters a receiver guide 36 which guides the dye receiver 30 to the first gap between the print head 23 and the roller platen 24.

Some time before the dye receiver 30 reaches the first gap, the dye donor 20 is moved in the same direction as the dye receiver 30 is moving by driving a take-up spool 16 with a first motor 18. Thus as the dye receiver 30 enters the first gap, the moving dye donor 20 assists the dye receiver 30 in entering the first gap. Movement of dye donor 20 must be initiated prior to the dye receiver 30 reaching the gap with a minimum amount of time just sufficient for the dye donor 20 to reach a desired speed when the dye receiver 30 enters the gap.

It is possible, though less desirable, to initiate dye donor movement earlier than this minimum sufficient time, including initiating dye donor movement at the same time the dye receiver 30 is picked from the supply tray 32. However, these later alternatives result in the movement of more dye donor than is desirable, and will require longer overall print cycle times.

After passing through the first gap, the dye receiver 30 is guided by the moving dye donor 20 toward a receiver drive mechanism 26, 28. The dye receiver 30 enters a second gap formed by a pinch roller 28 spaced away from a traction roller 26, and the leading edge of the dye receiver 30 is sensed by a receiver edge detector 40, which produces a receiver present signal.

A controller 11 which includes a microprocessor with a program in random access memory, responds to the receiver present signal and engages the pinch roller 28 to press the dye receiver 30 firmly between the receiver drive mechanism rollers 26, 28. The controller 11 may also stop movement of the dye donor 20. The dye receiver 30 may then be moved to a desired beginning receiver print position in preparation for normal printing operations.

A donor sensor emitter 42 and donor sensor detector 44 are spaced on either side of the dye donor and produce a color patch signal representative of which color patch is adjacent to the print head.

Figure 2:
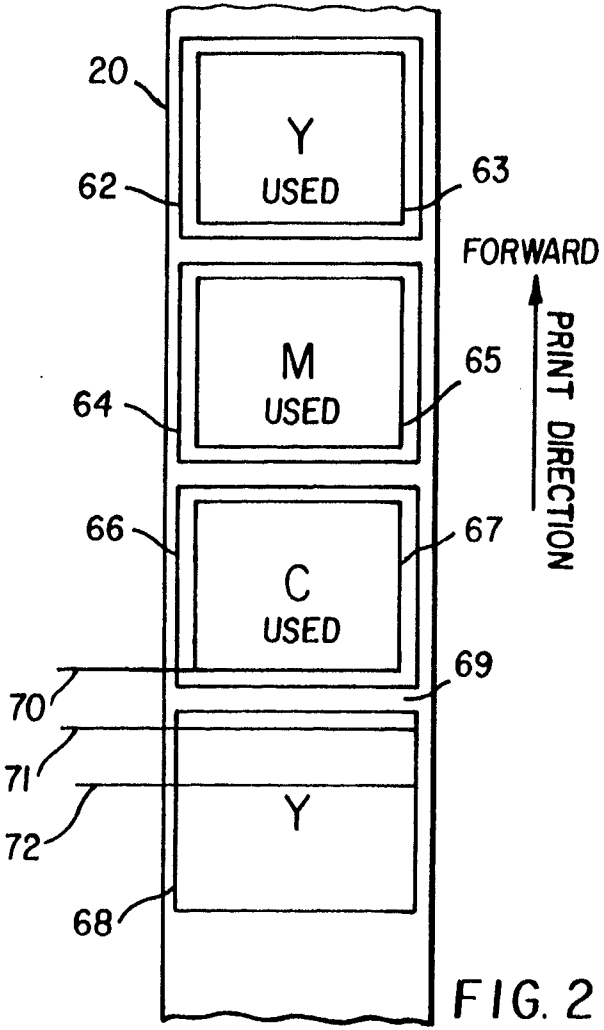
FIG. 2 is a schematic of a dye donor with repeating groups of sequential color patches showing print head positions at end of previous print, at beginning of next print and at a beginning donor print position for a maximum size previous image.

FIG. 2 shows a dye donor 20 with more than one group of sequential color patches. One group of sequential color patches 62, 64, 66, shall be referred to as a first group, which is followed by a first color patch 68 of a second group of sequential color patches.

Returning to FIG. 1, the controller 11, responds to the color patch signal and determines the position of the print head 23 relative to the color patches 62, 64, 66, on the dye donor 20. This determination compares the position of the print head 23 to a desired beginning print head position 71 for the first color patch in the next group of sequential color patches. An appropriate donor drive direction signal is then produced.

The donor drive direction signal can represent forward or reverse directions, depending upon where the print head 20 is, relative to the color patches on the dye donor 20, when the controller 11 receives the receiver present signal. The selection of the donor drive direction signal can be better understood by referring to FIGS. 2 and 3.

FIG. 2, as stated above, shows a dye donor 20 with repeating groups of sequential color patches. When printing has been completed for a first image, all color patches within the first group have been used (63, 65 and 67 respectively). At the end of a printing sequence for a maximum size image, the print head 23 is located at an end of print position 70. This end of print position 70 is located at the end of a used portion 67 of a final color patch 66 of the first group (62, 64, 66). For this example, the final color patch 66 in each group of color patches is cyan.

When a receiver loading sequence is initiated, the dye donor 20 is moved from an end of previous print position 70 until the controller 11 responds to the receiver present signal, stopping the dye donor 20 in an end of donor movement position 72. The actual location of the end of donor movement position 72 relative to the print head 23 depends upon the size the previously printed image, how long the dye donor 20 was moved before the dye receiver 30 entered the first gap and whether the dye receiver 30 came from the supply tray 32 or was manually fed by the operator.

The controller 11 determines if the end of donor movement position 72 is beyond a beginning print head position 71 where initial printing of the next image must start. This is done by comparing the color patch signal that the controller 11 receives at the end of previous print position 70 to the color patch signal that the controller 11 receives at the end of donor movement position 72. If these color patch signals are different, the controller 11 generates a reverse donor drive direction signal.

In another embodiment, the controller 11 could monitor the color patch signal more than twice for each receiver loading sequence (once at the end of previous print position 70 and again at the end of donor movement position 72). For example, the controller 11 could monitor the color patch signal several times during the receiver loading sequence, or the color patch signal could be monitored continuously. Each of these alternatives would perform the needed function, with varying degrees of impact on controller 11 complexity.

Figure 3:
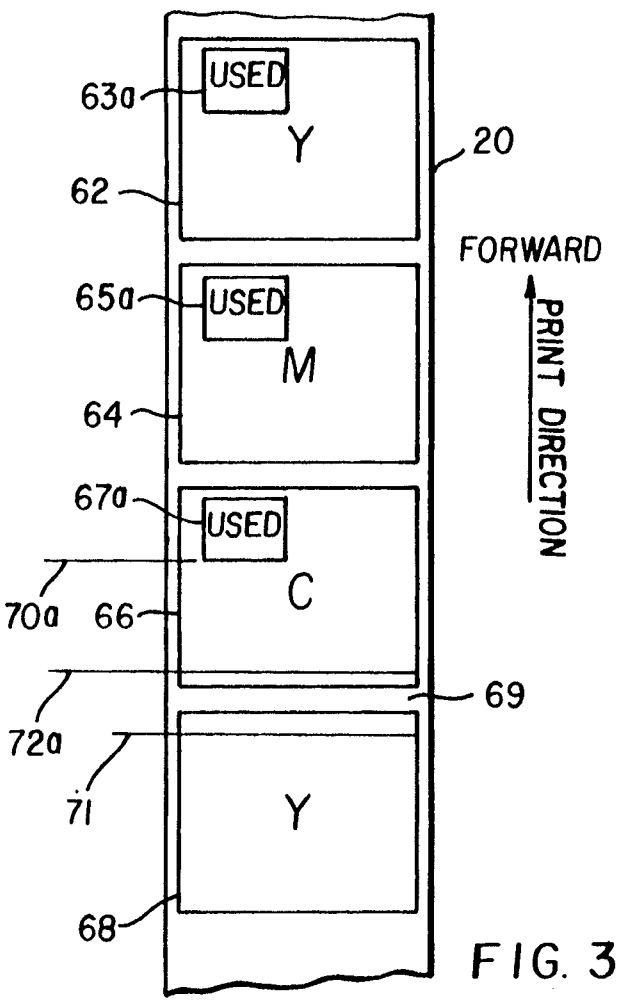
FIG. 3 shows a schematic similar to FIG. 2 except print head positions are shown for a small size image.

FIG. 3 shows a dye donor 20, similar to that in FIG. 2, except that a small image was printed previously. The first group of sequential color patches 62, 64, 66 is followed by a first color patch 68 of the second group of sequential color patches. When printing has been completed for the small image, all color patches within the first group 62, 64, 66, have been used (**63*a*, 65*a* and 67*a* respectively). At the end of a printing sequence for the small size image, the print head 23 is located at an end of print position 70a, which is located at the end of a used portion 67a of the final color patch 66, which is located within the first group (62, 64, 66**).

When a receiver loading sequence is initiated in the small image example, the dye donor 20 is moved from an end of previous print position 70a until the controller 11 responds to the receiver present signal, stopping the dye donor 20 in an end of donor movement position 72a. As stated above, the actual location of the end of donor movement position 72a relative to the print head 23 depends upon the size the previously printed image, how long the dye donor 20 was moved before the dye receiver 30 entered the first gap and whether the just loaded receiver 30 came from the supply tray 32 or was manually fed by the operator.

The controller 11 determines if the end of donor movement position 72a is beyond a beginning print head position 71 by comparing the color patch signal received by controller 11 at the end of previous print position 70a to the color patch signal that the controller 11 receives at the end of donor movement position 72a. In this small image example, these color patch signals are the same and the controller 11 generates a forward donor drive direction signal.

An alternative embodiment of the controller 11 may select a portion of a program to perform based upon the comparison of the color patch signal that the controller 11 receives at the end of previous print position 70a to the color patch signal that the controller 11 receives at the end of donor movement position 72a, rather than generating a donor drive direction signal.

Once the controller 11 receives the donor drive direction signal, the controller 11 engages a drive. In the case of a forward donor drive direction signal, the controller 11 engages the take-up spool drive 18 to move the dye donor 20 while the controller 11 monitors the color patch signal. When a blank space 69 between color patches passes the donor sensor emitter 42 and donor sensor detector 44, the color patch signal changes, and the color patch signal will change again when the first color patch of the second group of patches passes the donor sensor emitter 42 and donor sensor detector 44. The controller 11, responsive to these changes in the color patch signal, continues to move the dye donor 20 a first predetermined amount until the print head 23 is located at the beginning donor print position 71. The controller 11 then disengages the take-up spool drive 18 to stop movement of the dye donor 20.

In the case of a reverse donor drive direction signal, the controller 11 engages a supply spool drive 14 to move the dye donor 20 in the reverse direction while the controller 11 monitors the color patch signal. When a blank space 69 between color patches passes the donor sensor emitter 42 and donor sensor detector 44, the color patch signal changes, and the color patch signal will change again when the final color patch of the first group of patches passes the donor sensor emitter 42 and donor sensor detector 44. The controller 11, responsive to these changes in the color patch signal, continues to move the dye donor 20 in the reverse direction for a second predetermined time, after which the controller 11 disengages the supply spool drive 14 and the movement of the dye donor 20 in the reverse direction ceases. The controller 11 then engages the take-up spool drive 18 to move the dye donor 20 in the forward direction while the controller 11 monitors the color patch signal. When a blank space 69 again passes the donor sensor emitter 42 and donor sensor detector 44, the color patch signal changes, and the color patch signal changes yet again when the first color patch of the second group of patches passes the donor sensor emitter 42 and donor sensor detector 44. The controller 11, responsive to these changes in the color patch signal, continues to move the dye donor 20 a first predetermined amount until the print head 23 is located at the beginning donor print position 71. The controller 11 then disengages the take-up spool drive 18 to stop movement of the dye donor 20.

Once the dye donor 20 is located at the beginning donor print position 71 and the dye receiver 30 is at the desired beginning receiver print position (described earlier), normal thermal printing operations can begin in which information is printed upon the dye receiver 30.

It is recognized that alternatives can be employed to implement this invention. For example, the first motor 18 may drive the take-up spool 16 directly, or indirectly by gears or belts or other common techniques. Similar alternatives for the supply spool 12 and second motor 14 are also within the scope of this invention.

In another alternative to the above described apparatus, the controller 11, upon receipt of the receiver present signal and without first stopping the dye donor 20 from moving, may determine which direction the dye donor 20 must be moved and immediately drive the dye donor in the appropriate direction. This implementation may benefit from the controller regularly or continuously monitoring the color patch signal for changes while the dye donor moves.

Yet another alternative to the above described apparatus might involve the operation of driving the dye donor in reverse after the receiver present signal was received by the controller 11. In this modification the controller 11, after the second predetermined time has elapsed and without first stopping the dye donor 20 from its reverse movement, would immediately disengage the supply spool drive 14 and engage the take-up spool drive 18 to move the dye donor 20 in the forward direction. In both of these last two alternatives, care must be taken to avoid stretching or other undesirable effects on the dye donor 20.

In another alternative, the speed with which the dye donor 20 is moved need not be uniform, but rather could be incrementally adjusted faster or slower to avoid degrading the dye donor 20. For example, linear or non-linear ramping of drive speed could be utilized in place of a full off to full on (or the reverse) engagement of the drives.

Figure 4:
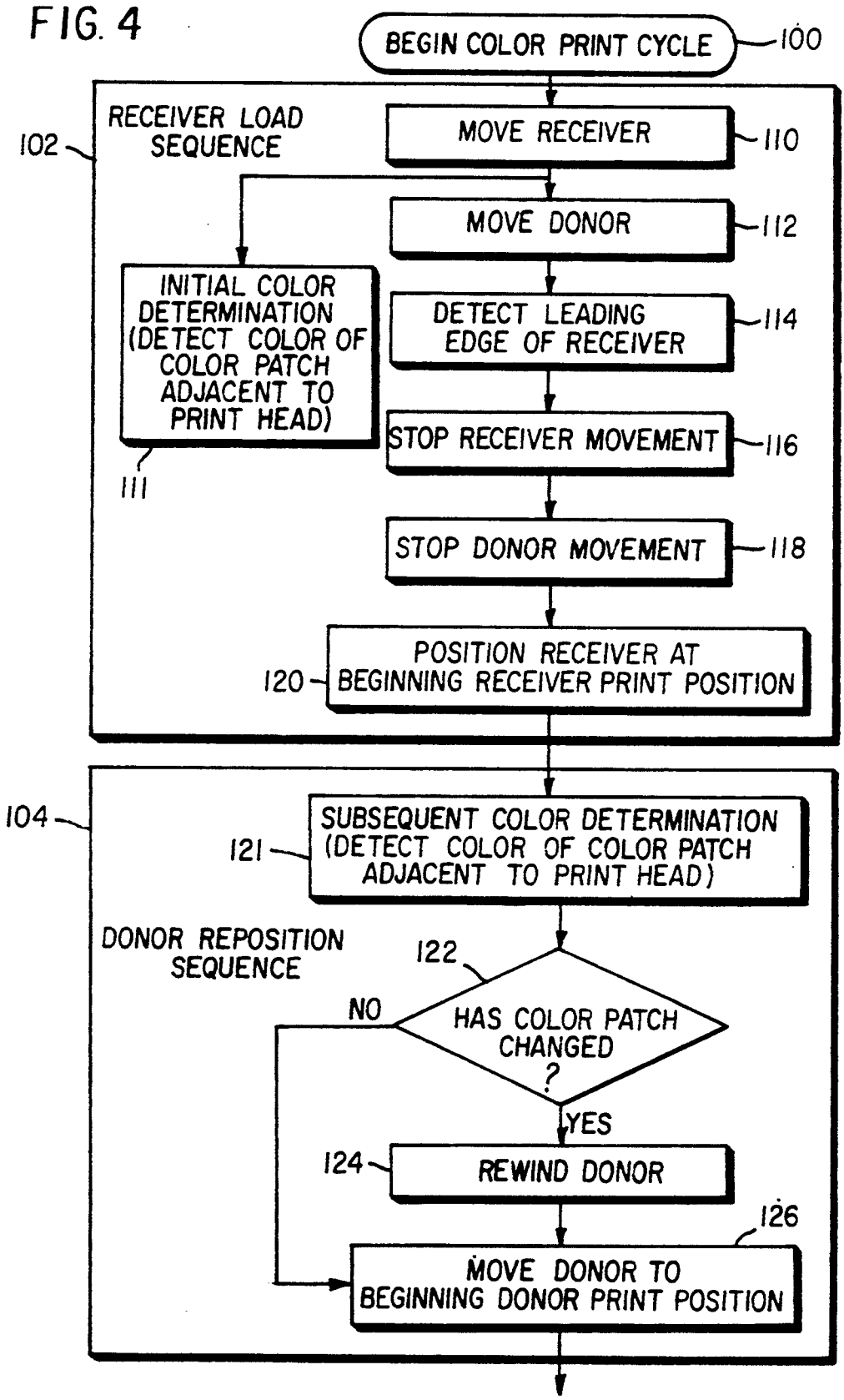
FIG. 4 shows a diagram of a portion of the control method of this invention for loading the dye receiver, repositioning the dye donor and printing an image on the dye receiver.
Figure 4:
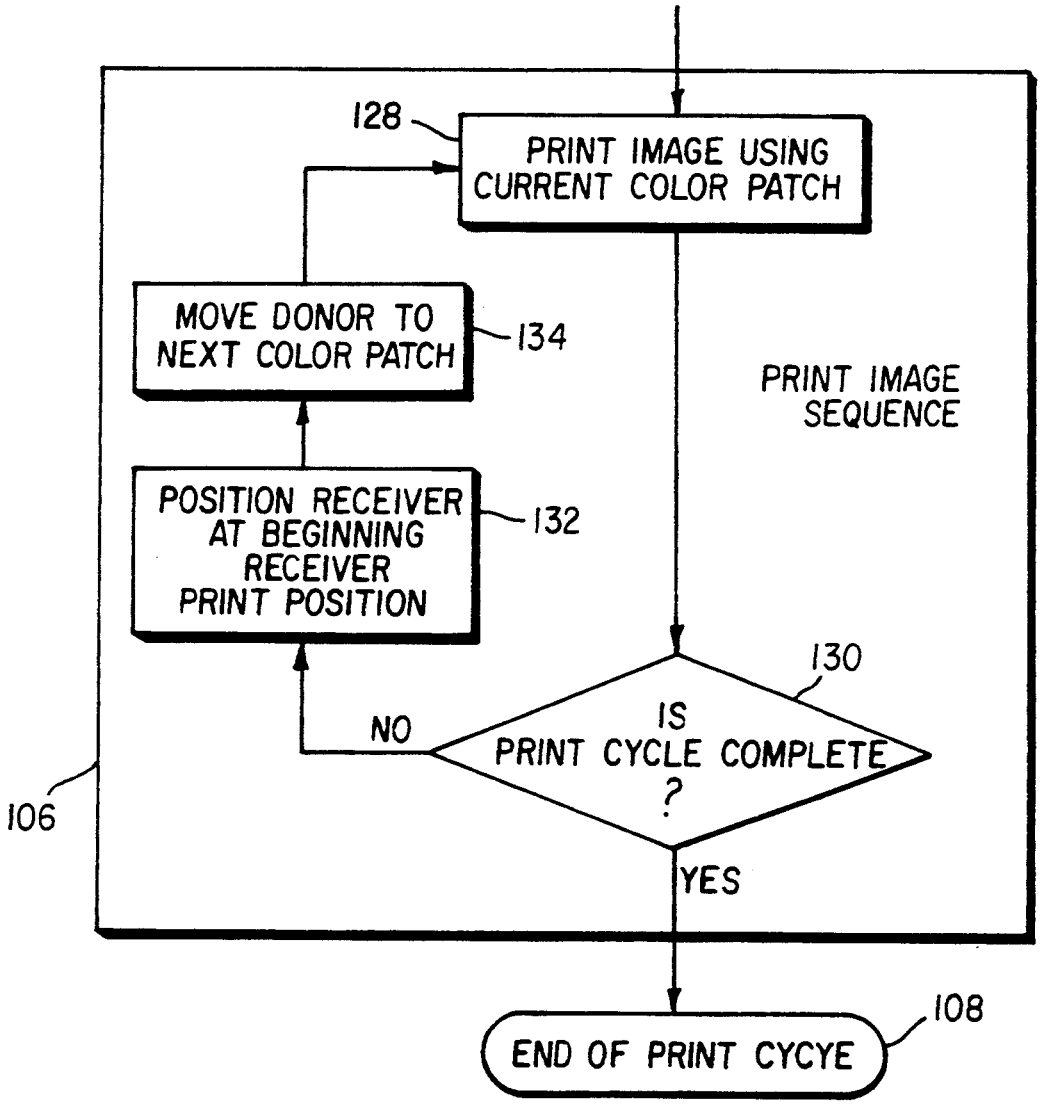

FIG. 4 diagrams a portion of the steps of a complete print cycle, showing those steps required to load a dye receiver and prepare to print an image in a thermal printer. Each print cycle includes at least a receiver loading sequence 102, a donor repositioning sequence 104 and a printing sequence 106 of steps. Although these sequences can be organized in several orders, there are benefits from organizing these sequences in this order. These benefits include minimum dye donor movement during loading, the least time requirement for the entire print cycle and elimination of errors due to dye donor substitution between sequences.

It is possible to rearrange the relative order of the receiver loading 102, donor positioning 104 and printing sequences 106. For example, after printing 106 an image, the next receiver 30 could be loaded 102 and the dye donor 20 repositioned 104 in preparation for the next print cycle. This alternative is less desirable because it takes more time to perform the entire print cycle and requires the most dye donor movement of the alternative methods. Also, it is susceptible to errors if the user should change dye donor 20 between print cycles. Another sequence order could include donor repositioning 104, receiver loading 102 and printing 106. This embodiment suffers the same problems as the previous alternative, and also increases the total time required to deliver a print to the user.

At an appropriate time after the color print cycle begins 100, the receiver loading sequence 102 occurs. This sequence begins by moving 110 the dye receiver 30 toward the first gap between the print head 23 and the platen 24. Before the dye receiver 30 reaches the first gap, the dye donor 20 is moved 112 in the same direction as the dye receiver 30. This insures that as the dye receiver 30 enters the first gap, the moving dye donor 20 assists the dye receiver 30 in entering the first gap.

Dye donor movement must be initiated prior to the dye receiver 30 reaching the gap by an amount of time sufficient for the dye donor 20 to have reached the desired speed when the dye receiver 30 enters the gap. Dye donor movement can be initiated even earlier to provide more than this minimum sufficient time, up to and including initiating dye donor movement at the same time the dye receiver 30 is picked from the supply tray 32.

The color of the color patch adjacent to the print head 23 is determined 111 initially some time between the start of the receiver movement step 110 and a short time after the donor movement step 112. This initial color determination 111 is maintained or stored by the controller 11 for use by a future method step.

After passing through the first gap and the second gap between capstan 26 and pinch roller 28, the leading edge of the dye receiver 30 is detected 114. The controller 11 which includes a microprocessor with a program in random access memory, in response to the receiver present signal, stops the receiver movement 116 by engaging the receiver drive mechanism rollers 26, 28. The controller 11 may also stop the dye donor movement 118. The dye receiver 30 is then positioned 120 to a desired beginning receiver print position in preparation for normal printing operations.

The donor repositioning sequence 104 begins after the stop receiver movement step 116 and the stop donor movement step 118 have occurred. The first step of this sequence is a subsequent color determination step 121 which determines the color of the color patch adjacent to the print head 23 at the end of the stop donor movement step 118. This is followed by a determination of whether the color patch adjacent to the print head 23 has changed 122 by comparing the initial color determination 111 result with the subsequent color determination 121 result.

If the initial and subsequent color determination results 111, 121 are different, then the rewind donor step 124 occurs where the dye donor 20 is rewound a sufficient amount to insure the print head 23 is ahead of the beginning donor print position 71. This rewind donor step 124 may include one or more additional determinations of the color of the color patch adjacent to the print head 23 to determine when enough dye donor 20 has been rewound.

When the rewind donor step 124 is complete, the dye donor 20 is moved 126 again until the dye donor 20 is positioned at the beginning donor print position 71. Again, one or more additional determinations of the color of the color patch adjacent to the print head 23 to determine when the dye donor 20 has moved to the first color patch 68 of the second group of color patches, whereupon the dye donor 20 is moved until it is positioned at the beginning donor print position 71.

If the initial and subsequent color determination results 111, 121 are the same, then the rewind donor step 124 does not occur, and the dye donor 20 is moved 126 until the dye donor 20 is positioned at the beginning donor print position 71. As before, one or more additional determinations of the color of the color patch adjacent to the print head 23 to determine when the dye donor 20 has moved to the first color patch 68 of the second group of color patches, whereupon the dye donor 20 is moved until it is positioned at the beginning donor print position 71.

The print image sequence 106 follows the donor repositioning sequence 104. The initial step in the print image sequence 106 is printing information 128 with the current color patch of the second group of color patches. This is followed by a determination of whether printing is complete 130. If more information must be printed, the dye receiver 30 is repositioned 132 at the beginning receiver print position and the dye donor 20 is moved 134 to the next color patch of the second group of color patches. The print image sequence 106 continues by repeating the print information step 128, followed by the determination of whether printing is complete 130 again. This loop continues until all color patch information has been printed for the image. When the determination has been made that the image is complete 130, the print image sequence complete.

Summarizing, this apparatus functions to assist loading dye receiver 30 by moving the exact amount of dye donor 20 required to assist the dye receiver 30 into position without waste. Dye donor movement occurs only as long as necessary for a dye receiver 30 to reach the proper printing position regardless of where in the receiver transport path it started. The embodiment works properly regardless of the size of the preceding print; functions properly if a dye donor 20 is changed between prints; is insensitive to the errors which affect alternative embodiments; requires the least amount of time to print; and entails the least mechanical movement of the dye donor 20.

The invention has been described in detail with particular reference to certain preferred embodiments thereof, but it will be understood that variations and modifications can be effected within the spirit and scope of the invention.

What is claimed is:

1. A color thermal printer which uses a dye donor with repeating groups of sequential color patches and a dye receiver, the printer including a print head, which in a first position is located away from a roller platen, thereby releasing a dye donor from any clamping pressure and leaving a gap between the print head and a platen, and in a second position the print head presses the dye donor against the dye receiver and the platen, and said printer further defines a receiver transport path, comprising:

a) means for moving the dye receiver in a first direction along the receiver transport path to the gap between the print head and the platen; and b) means for moving the dye donor in said first direction while the dye receiver is moving in said first direction so that the dye donor engages said moving dye receiver and assists the dye receiver to move through the gap during dye receiver insertion.

2. The color thermal printer set forth in claim 1 further comprising:

a) means for detecting the dye receiver in the receiver transport path downstream of said gap to produce a receiver present signal;

b) means for stopping the movement of the dye donor in response to said receiver present signal;

c) means for positioning the dye receiver at a beginning receiver print position in response to said receiver present signal;

d) means for positioning the dye donor at a beginning donor print position after the movement of the dye donor stops; and e) means for printing information upon the dye receiver.

3. The color thermal printer set forth in claim 2 wherein the means for dye donor positioning further comprises:

a) means for sensing which of the sequential color patches is positioned in the gap between the print head and the platen, and producing a color patch signal representative of the particular color patch being sensed;

b) means for determining the position of the print head relative to the first color patch in the next group of sequential color patches, and producing a donor drive direction signal representative of the direction the dye donor must move to position the dye donor at said beginning donor print position; and c) means for moving the dye donor in response to said donor drive direction signal to position the next group of sequential color patches at said beginning donor print position.

4. A color thermal printer which uses a dye donor with repeating groups of sequential color patches and a dye receiver, the printer including a print head, which in a first position is located away from a roller platen, thereby releasing a dye donor from any clamping pressure and leaving a gap between the print head and a platen, and in a second position the print head presses the dye donor against the dye receiver and the platen, and said printer further defines a receiver transport path, comprising:

a) means for moving the dye receiver in a first direction through the gap between the print head and the platen;

b) means for moving the dye donor in said first direction while the dye receiver is moving so that the dye donor assists the dye receiver to pass through the gap has been inserted;

c) means for detecting when the dye receiver is downstream of the gap whereupon the detecting means produces a receiver present signal;

d) means for moving the dye receiver in a second direction opposite said first direction in response to said receiver present signal until the dye receiver is in a beginning receiver print position;

e) means for detecting which color patch is adjacent to the print head during the dye donor moving step whereupon said detecting means produces a color patch signal;

f) means for further moving the dye donor in said first direction in response to said receiver present signal and said color patch signal until the dye donor is positioned at a beginning donor print position; and g) means for printing information upon the dye receiver.

5. The color thermal printer set forth in claim 4 wherein receiver second direction moving means further includes means for moving the dye receiver in said second direction until the dye receiver has past said beginning receiver print position, whereupon the dye receiver is transported in said first direction until the dye receiver is in said beginning receiver print position.

6. The color thermal printer set forth in claim 4 wherein said means for detecting which color patch is adjacent to the print head further includes:

a) means for determining a change in said color patch signal during said dye donor moving step and producing a color patch changed signal;

b) means for rewinding the dye donor in response to said receiver present signal and said color patch changed signal by moving the dye donor in a second direction opposite said first direction until a previous color patch is detected, and producing a color patch signal; and c) means for moving the dye donor in said first direction in response to said color patch signal and said receiver present signal until the dye donor is positioned at a beginning donor print position.

* * * * *

UNITED STATES PATENT AND TRADEMARK OFFICE

CERTIFICATE OF CORRECTION

PATENT NO. : 5,399,031
DATED : March 21, 1995
INVENTOR(S) : James A. Whritenor

It is certified that error appears in the above-indentified patent and that said Letters Patent is hereby corrected as shown below:

Col. 10, claim 4, line 7, delete "has been inserted" and insert --during dye receiver insertion--.

Signed and Sealed this

Sixth Day of February, 1996

Bruce Lehman

*Attest:*

BRUCE LEHMAN

*Attesting Officer*

*Commissioner of Patents and Trademarks*